US006315008B2

(12) United States Patent
Dornier et al.

(10) Patent No.: US 6,315,008 B2
(45) Date of Patent: Nov. 13, 2001

(54) WEAVING LOOM FOR PRODUCING A LENO FABRIC

(75) Inventors: Peter D. Dornier; Adnan Wahhoud, both of Lindau; Valentin Krumm, Hergensweiler; Horst Haeussler, Lindau; Juergen Vossen, Kressbronn, all of (DE); Josef Hehle, Hoerbranz (AT)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/772,390

(22) Filed: Jan. 29, 2001

(30) Foreign Application Priority Data

Jan. 29, 2000 (DE) ..... 100 03 919
Nov. 21, 2000 (DE) ..... 100 57 692

(51) Int. Cl.[7] ..... D03C 7/06
(52) U.S. Cl. ..... 139/50
(58) Field of Search ..... 139/50, 54

(56) References Cited

U.S. PATENT DOCUMENTS 2,647,541 * 8/1953 Nichols ..... 139/50
3,255,783 * 6/1966 Wall ..... 139/50
6,092,559 * 7/2000 Dvorak et al. ..... 139/50

FOREIGN PATENT DOCUMENTS

WO 98/07913 2/1998 (WO) .

* cited by examiner

*Primary Examiner*—Andy Falik
(74) *Attorney, Agent, or Firm*—W. F. Fasse; W. G. Fasse

(57) ABSTRACT

A warp thread control system for forming the loom shed as a first control section (1) and a second warp control section (16). The first section is equipped with at least one guide element (2) for guiding the leno threads (3) and a guide rod (4) carrying a multitude of passages 6 arranged and parallel to one another for guiding the ground threads (5). The second warp control section (16) includes a thread detour element (17) for detouring the leno threads (3) and a needle bar (18) carrying a multitude of needles (19) with needle eyes (19.1) for guiding the leno threads (3). Both the first warp control section (1) and the second warp control section (16) are positioned on the side of the reed facing the warp threads whereby the positioning may differ either above or below a weaving plane (28) or partially above and partially below the weaving plane (28). Preferably but not necessarily both warp control sections are driven by a common drive (11).

24 Claims, 11 Drawing Sheets

WEAVING LOOM FOR PRODUCING A LENO FABRIC

PRIORITY CLAIM

This application is based on and claims the priority under 35 U.S.C. §119 of German Patent Application 100 03 919.7, filed on Jan. 29, 2000, and 100 57 692.3, filed on Nov. 21, 2000, the entire disclosures of which are incorporated herein by reference.

FIELD OF THE INVENTION

The invention relates to a weaving loom for the production of a leno fabric or cloth in which warp guide sections are provided for guiding the leno threads and the ground threads in the proper loom shed formation.

BACKGROUND INFORMATION

International Patent Publication WO 98/07913 discloses a device for controlling warp threads for the production of leno fabrics on a textile machine. Preferably the known device is part of a weaving loom and includes a sley carrying a conventional reed. A needle carrier carrying a multitude of needles is positioned above the fabric plane on the side of the reed facing the warps. The fabric plane is determined by the position of the beat-up line which extends in the fabric plane. Each of the needles comprises a needle eye. The needle carrier is operatively connected with a drive which oscillates the needle carrier together with the leno warp threads in a motion extending vertically to the fabric or weaving plane for opening and closing the shed.

A first heald frame is arranged downstream of the needle carrier on the warp facing side of the reed. The first heald frame is driven in a plane vertically to the weaving or fabric plane. The first heald frame comprises a guide bar positioned approximately in the fabric plane. The guide bar is provided with a multitude of slots arranged in a row and extending at a slant. One warp leno thread is guided in each of these slots, whereby an oscillatory cross motion is imposed on the warp threads in response to the oscillating vertical motion of the heald shaft. A second heald shaft is positioned on the warp side downstream of the first heald shaft. The second heald shaft is driven in a plane vertically to the weaving plane. The second heald shaft comprises a rod positioned approximately in the weaving plane. The rod is equipped with a slot extending crosswise and parallel to the weaving plane. The leno warp threads are guided in this slot.

A third heald frame drive for a vertical oscillating movement is equipped with a pair of compensating rollers. These rollers are driven relative to the third heald frame and the rotational direction of these rollers can be reversed in a controlled manner, for example by a drive that is operatively connected with a drive shaft.

The above described conventional warp thread control requires a substantial effort and expense for its construction due to the numerous components and their intricate cooperation. Another disadvantage is seen in that at least three separate drives are required, namely one drive for operating the heald frames, a second drive for the needle bar, and a third drive for the compensation rollers.

Another disadvantage of the conventional warp thread control is seen in that it requires means referred to as so-called negatively effective elements for displacing the leno threads in case the leno threads are insufficiently tensioned or if they are exposed to uneven tensions. In that case the leno threads are no longer positively guided in the slanted slots of the heald or shaft frame. As a result at least some of the leno threads do not perform an oscillating horizontally extending motion relative to the ground threads. Hence, faulty bindings and flaws are unavoidably formed in the leno fabric.

OBJECTS OF THE INVENTION

In view of the foregoing it is the aim of the invention to achieve the following objects singly or in combination:

- to provide a weaving loom for producing leno fabrics having leno threads, ground threads, and weft threads, whereby the loom construction, compared to the prior art, is to be simplified while simultaneously avoiding the drawbacks of the prior art;
- to improve the control or guiding of the leno threads and thus of the shed formation by simpler leno control sections; and
- to reduce the number of drives for the warp control to not more than two drives, preferably only one drive for the vertical and horizontal motion of the warp control sections.

SUMMARY OF THE INVENTION

The above object have been achieved according to the invention by a weaving loom for producing a leno fabric which is woven of leno threads and ground threads forming warp threads and of weft threads, said weaving loom comprising a sley and a reed mounted on said sley, said reed defining a beat-up line in a beat-up position of said reed, said beat-up line extending in a weaving plane, said weaving loom further comprising a fabric guide positioned alongside said beat-up line for guiding said leno fabric downstream of said reed as viewed in a fabric withdrawal direction, and a warp control mechanism for controlling the movement of said warp threads upstream of said reed, said warp control mechanism comprising a first warp control section and a second warp control section, said first warp control section comprising at least one guide member for guiding said leno threads and a guide rod having a first plurality of passages for guiding said ground threads, said second warp control section comprising a thread detouring element for detouring said leno threads, and a needle bar having a second plurality of needles with needle eyes for guiding said leno threads wherein said first and second warp control sections are arranged in said weaving loom below said weaving plane, said weaving loom further comprising a common drive operatively connected to said first and second warp control sections for operating said first and second warp control sections.

According to the invention the first warp control section comprises guide elements for guiding the leno threads and guide elements for guiding the ground threads. The ground thread guides include a rod with a multitude of passages that extend axially in parallel to each other and that provide one passage for each ground thread. These passages are either upwardly open or closed. In both instances the arrangement of these passages form a new type of reed. The second warp control section comprises, on the warp facing side of the reed, preferably between the reed and the first warp control section, components for guiding and detouring the ground threads. The second warp control section comprises a needle bar carrying a multitude of needles arranged in a row. Each needle is provided with a needle eye. The second warp control section also includes a thread detouring element arranged next to the needle bar. Both the first and the second warp control sections have a length extending over the weaving width across the loom. A common drive is operatively connected to the first warp control section and to the second warp control section in such a way that the first warp control section is oscillated in a horizontal direction relative to the weaving plane while the second warp control section is oscillated vertically relative to the weaving plane.

The first warp control section comprises a support frame having an upwardly open U-frame configuration, including a first frame leg carrying at its free end the leno thread guide element or elements. The above mentioned multitude of axially parallel passages for the ground threads is arranged at the free end of the leno thread guide.

A support frame for the needle bar and for the detouring element is positioned between the first frame leg and the second frame leg of the U-configuration support frame, whereby the needle bar support frame is vertically displaceable up and down between the first and second legs of the U-configuration frame of the first warp thread control section.

The vertical displaceability of the support for the second warp control section is enhanced, for example by sliding guides formed on the inner inwardly facing surfaces of the legs of the U-configuration or these guides are formed directly by the inwardly facing surfaces of the U-configuration of the support frame for the first warp control section.

The support frame for the needle bar and the detour element is provided at its end opposite the needle bar and the detour element with a plurality of coupling members which include connector rods for providing a drive transmission between the support frames and the common drive. In the same way the support frame for the ground thread guide has at its end opposite the ground thread guide at least one connector for operatively coupling the U-shaped support frame configuration to the common drive. The second coupling also includes connector rods and both connector rods are preferably adjustable in their effective length, for example in the form of piston cylinder devices or telescoping devices the common drive for horizontally oscillating the first U-configuration support frame and for vertically oscillating the second support frame is preferably an eccentric cam disk which may, for example be constructed similar to a loom shed forming drive.

According to the second embodiment of the invention, the first warp control section and the second warp control section each have their separate drives for performing the horizontal oscillation of the first warp control section and for performing the vertical oscillating motion of the second warp control section. While is preferred that the drive for the second warp control section is an eccentric cam drive, the separate drive for the first warp control section is preferably selected from pneumatic drives, electromagnetic drives or electromotor drives.

According to another embodiment of the invention the first warp control section comprises a first support frame having an upwardly reaching free end extending above the weaving plane. The free end of the support frame carries a bar with a multitude of axially parallel ground thread passages, whereby the first support frame is provided with a drive for performing a horizontal oscillating motion while the second warp control section comprises a second support frame in the form of a needle shaft carrying above the weaving plane a support element for a needle bar which in turn carries a multitude of needles arranged in a row, each having a needle eye. Additionally, a leno detour element is arranged in the area of the needle bar and the second support frame is equipped with a drive for performing a vertically oscillating motion. The first and second warp control sections, or rather their support frames extend over the weaving width, whereby each of the first and second warp control sections are connected with a drive transmission coupling to the above mentioned drives which are preferably provided in the form of a common drive for both sections. Preferably, the common drive comprises an eccentric cam disk which is more preferably part of an eccentric cam disk machine. The just described embodiment is particularly useful in machines operating with a fluidic weft insertion such as an air jet weft insertion or with a mechanical weft insertion, for example by means of gripper rods.

In still another embodiment of the invention the detour elements for the leno threads are avoided altogether and the support frame for the first warp control section is constructed in the manner of a heald frame which is connected to the respective drive. The head frame carries a lamellae needle bar for guiding of the leno threads and of the ground threads. The second warp control section also carries at its upper free end a second lamellae needle bar for guiding the leno and ground threads. Both lamellae needle bars are arranged on the warp facing side of the reed, whereby the first lamellae needle bar is arranged above the weaving plane and the second lamellae needle bar is arranged below the weaving plane. Both needle bars through their respective supports are driven by a common drive. Preferably, the free end of all lamellae of the first and second lamellae bars are interconnected by a respective cross-piece extending over the length of the respective lamellae bar.

Except for the third embodiment, the first, second and fourth embodiments of the invention as described above have the advantage of using a common drive for performing the horizontal oscillating motion of the first warp control section which guides the ground threads and for performing the vertical oscillation motion of the second warp control section which guides the leno threads.

By imposing a positive horizontal oscillating motion on the ground threads, tension variations in the warp, that is in the ground threads and/or in the leno threads, are substantially neutralized or made ineffective so that binding errors are substantially excluded from the fabric.

The advantage of the third embodiment is seen in that it does not require any detouring elements for the leno threads. This has the advantage of avoiding bending moments in the needles that guide the leno threads when the loom shed is being formed. Another advantage of the third embodiment is seen in that the leno threads comb through between neighboring ground threads during the loom shed formation between the warp thread stop motion device and the beat-up line of the fabric. As a result, no fiber fly or fiber dust is deposited on the ground threads. By closing the gaps between the lamellae of the lamellae needle bars at their upper free ends with a cross-piece, the advantage is achieved that the ground threads do not escape their guiding even if they become momentarily tensionless, for example when the shed change occurs.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
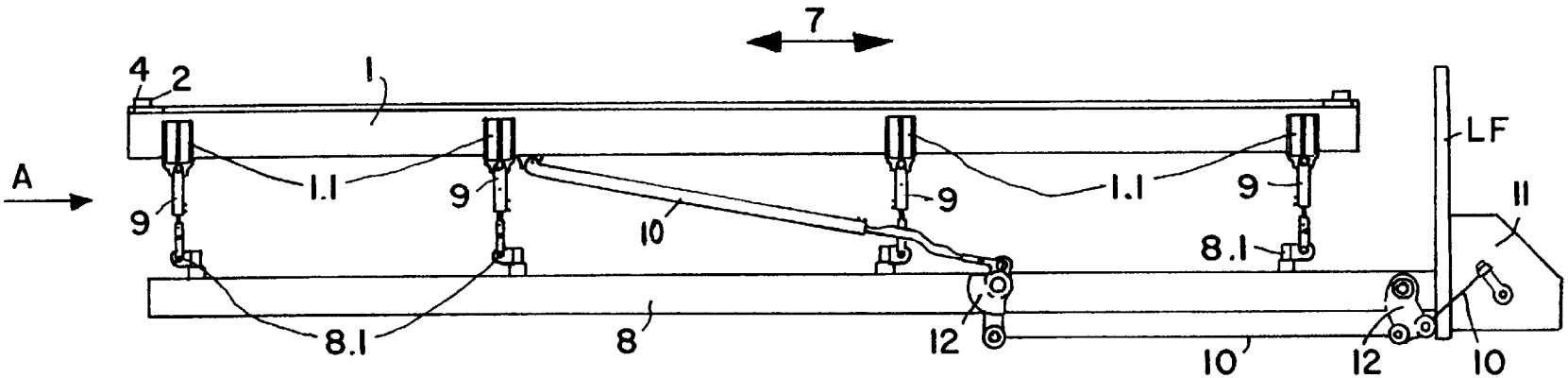
FIG. 1 shows a front view of the first warp control section including a support frame with guide elements for the leno threads and including a guide rod for guiding the ground threads, whereby a drive transmission coupling is connected between the first support frame structure and a shed forming drive.

FIG. 1 shows the first embodiment according to the invention illustrating the first warp control section 1 constructed as a frame structure having a horizontal length extending over the weaving width of a loom. The first section 1 includes a guide member 2 for guiding the leno threads 3 and a guide bar 4 for guiding the ground threads 5 as seen in more detail in FIGS. 6 and 8. The guide element 2 comprises a reed type thread guide connected to the frame structure of the first warp control section 1. The guide bar 4 comprises a multitude of passages 6 extending axially and parallel relative to each other. One passage 6 is provided for each ground thread. The passages 6 may be optionally upwardly open or closed.

The first section 1 is connected to a drive 11 through a drive transmission to be described below for driving a horizontal oscillatory motion as indicated by the arrow 7. This motion is limited to a few millimeters which are adequate to properly guide the ground threads 5. For this purpose the frame of section 1 is connected through vertically oriented connector rods 9 and journals 1.1 and through further connector journals 8.1 to a crossbeam 8 rigidly secured to a loom frame LF. The connector journals 8.1 are optionally oriented either vertically or horizontally. The connector journals or pivots 1.1 and 8.1 are interconnected by the rods 9 which are preferably adjustable in their length for example by piston cylinder devices or telescoping devices. These connections due to their pivoting or journaling permit the horizontal oscillating movement in the direction of the double arrow 7. Further coupling elements 10 provide a drive transmission to the drive 11. A connector element 12 acts in the manner of a bell crank. For this purpose the element 12 is journaled to the crossbeam 8 of the loom frame LF.

Figure 2:
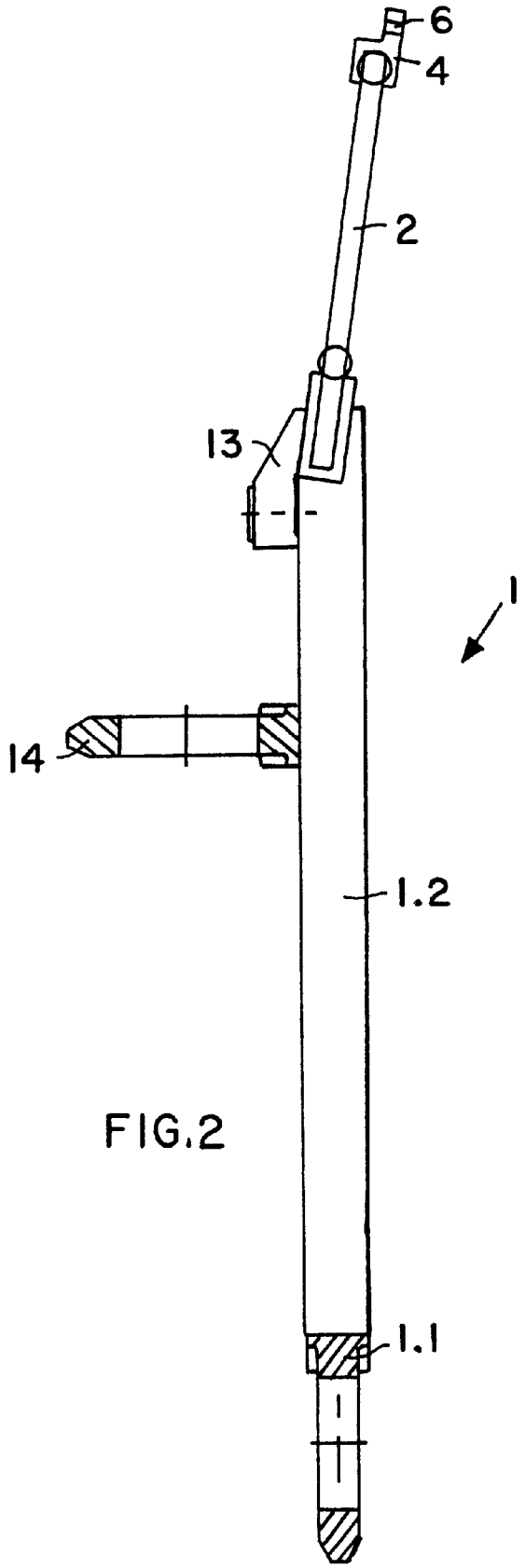
FIG. 2 shows a side view in the direction of the arrow II in FIG. 1 illustrating the guide rod for guiding the ground threads.

FIG. 2 illustrates in a side view partially in section the frame 1.2 of the first warp control section 1. The lower end of the frame 1.2 carries a journal bearing 1.1. A clamping rod 13 secures the guide member 2 to the upper end of the frame 1.2. The guide member 2 carries at its upper end a guide bar 4 with passages 6 for guiding the ground threads 5 not shown in FIG. 2. The passages 6 in FIG. 2 are closed in the upward direction. All passages 6 extend in parallel to one another.

Figure 8:
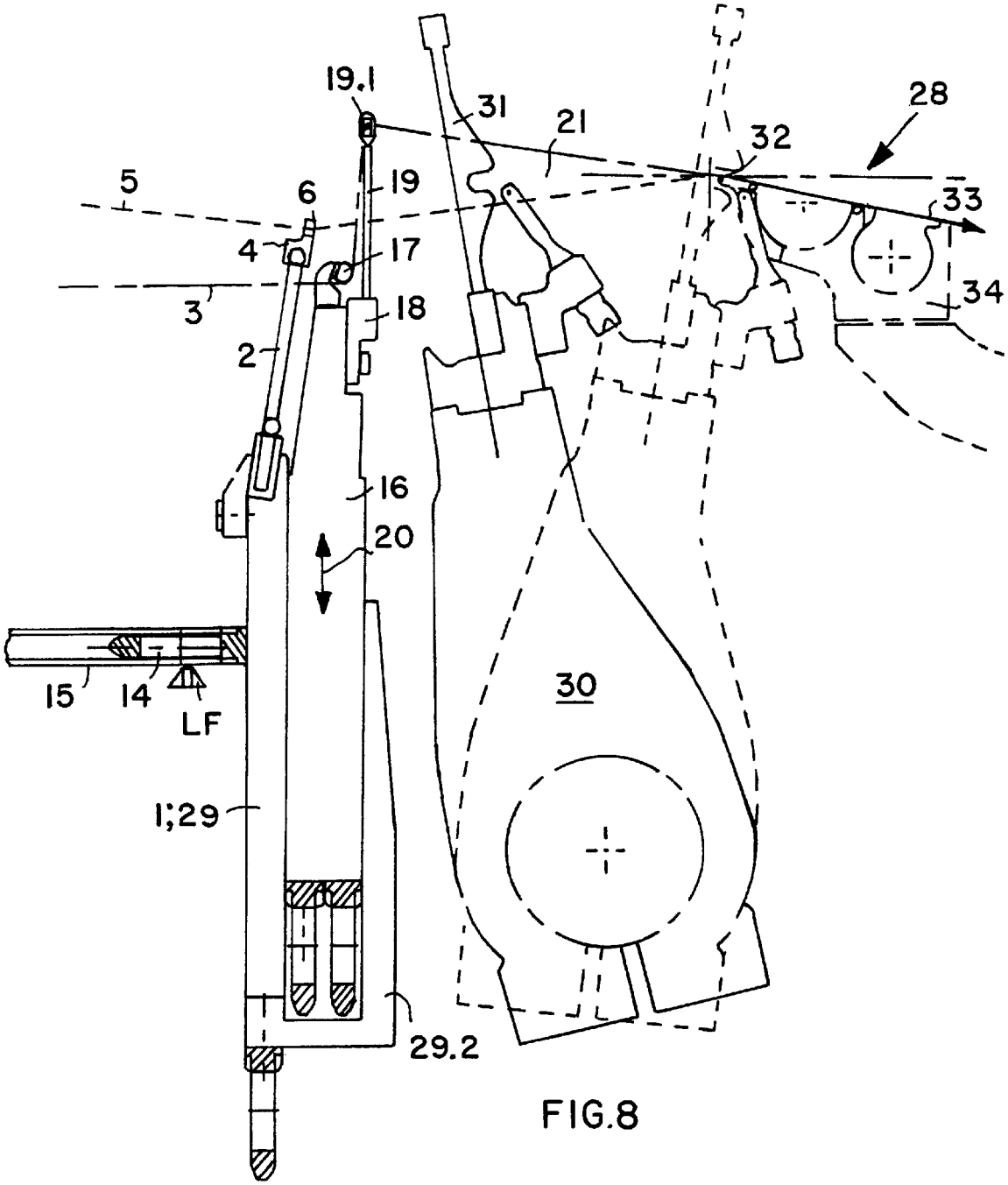
FIG. 8 shows a side view partially in section of the embodiment in which the support frame structures are positioned below the weaving plane while certain guide and detour elements are arranged above or below the weaving plane in the area of the reed.

In order to avoid a cross motion of the frame 1.2 relative to the horizontal motion thereof, the first section 1 or rather its frame 1.2 is equipped with a coupling 14 that cooperates with a coupling and guide element 15 shown in FIG. 8. The coupling and guide element 15 permits the horizontal oscillating motion either by following the motion or by permitting a relative sliding guided motion between the coupling 14 and the element 15. For this purpose the element 15 is either rigidly or slidably secured to the fixed loom frame LF. The coupling and guide element 15 may for example be constructed as a coupling member or as a spring elastic connection device.

Figure 3:
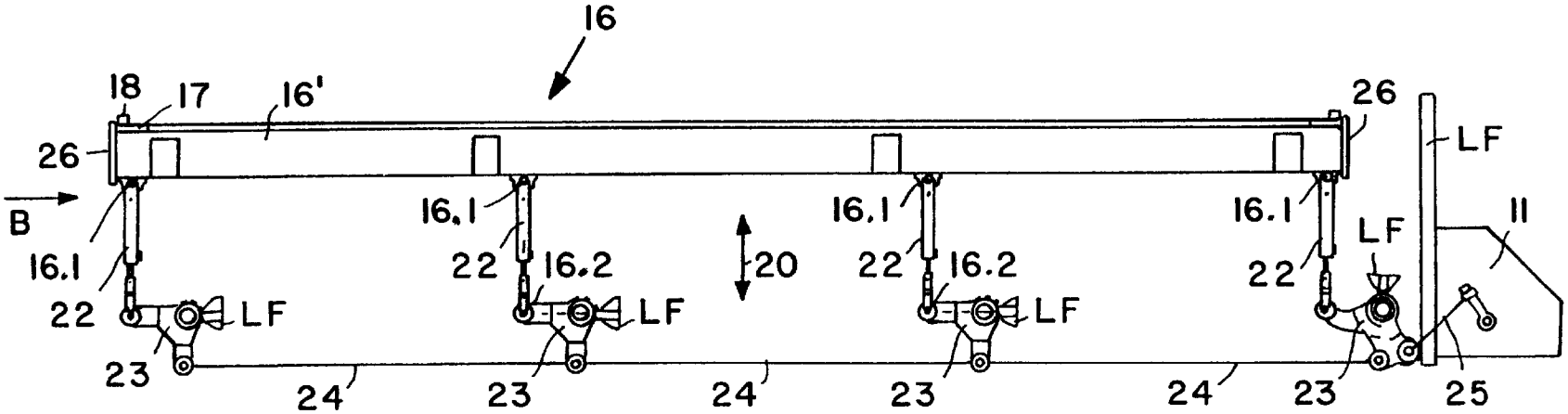
FIG. 3 shows the second warp control section including also a frame structure supporting the elements for guiding the leno threads and with the needle bar or carrier with the leno thread needles in the front view including a drive transmission coupling between the second warp control section and the loom shed forming drive or machine.
Figure 4:
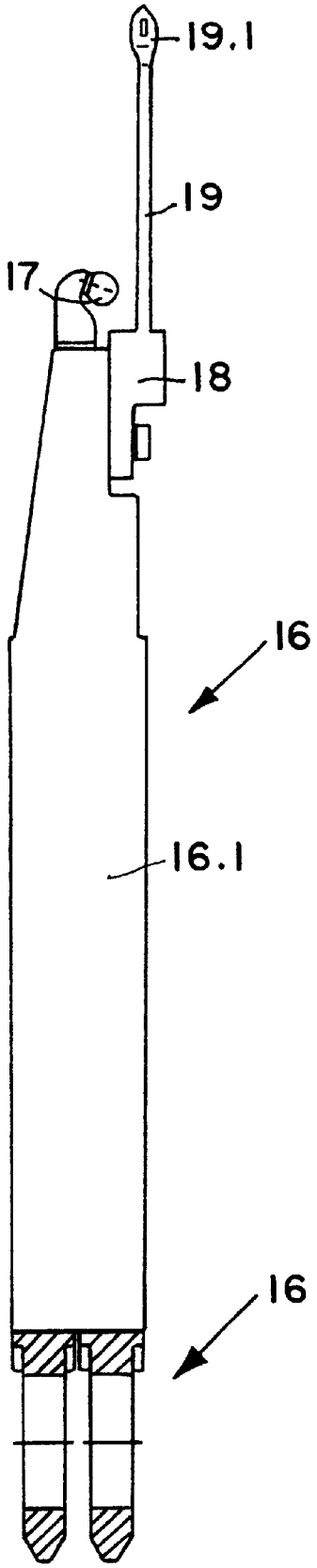
FIG. 4 shows a second frame construction supporting the second warp control section for guiding the leno threads and with a needle bar for guiding the leno threads, whereby the view is in the direction of the arrow IV in FIG. 3.

FIG. 3 shows a view similar to that of FIG. 1, however illustrating the second warp control section 16 which is constructed, mounted and driven for a vertical oscillating motion. A support frame structure 16' of section 16 also extends over the weaving width of the loom and carries a thread detour element 17 functioning as a detour roller. As seen in FIG. 4, the detour element 17 is arranged at the upper end of the frame structure 16' of section 16. The frame 16' also carries a needle bar 18 with a multitude of needles 19 for guiding the leno threads 3. The needle bar serves simultaneously for the formation of the loom shed. Each needle 19 has a needle eye 19.1 through which one leno thread 3 is guided as best seen in FIGS. 8 and 9.

Figure 9:
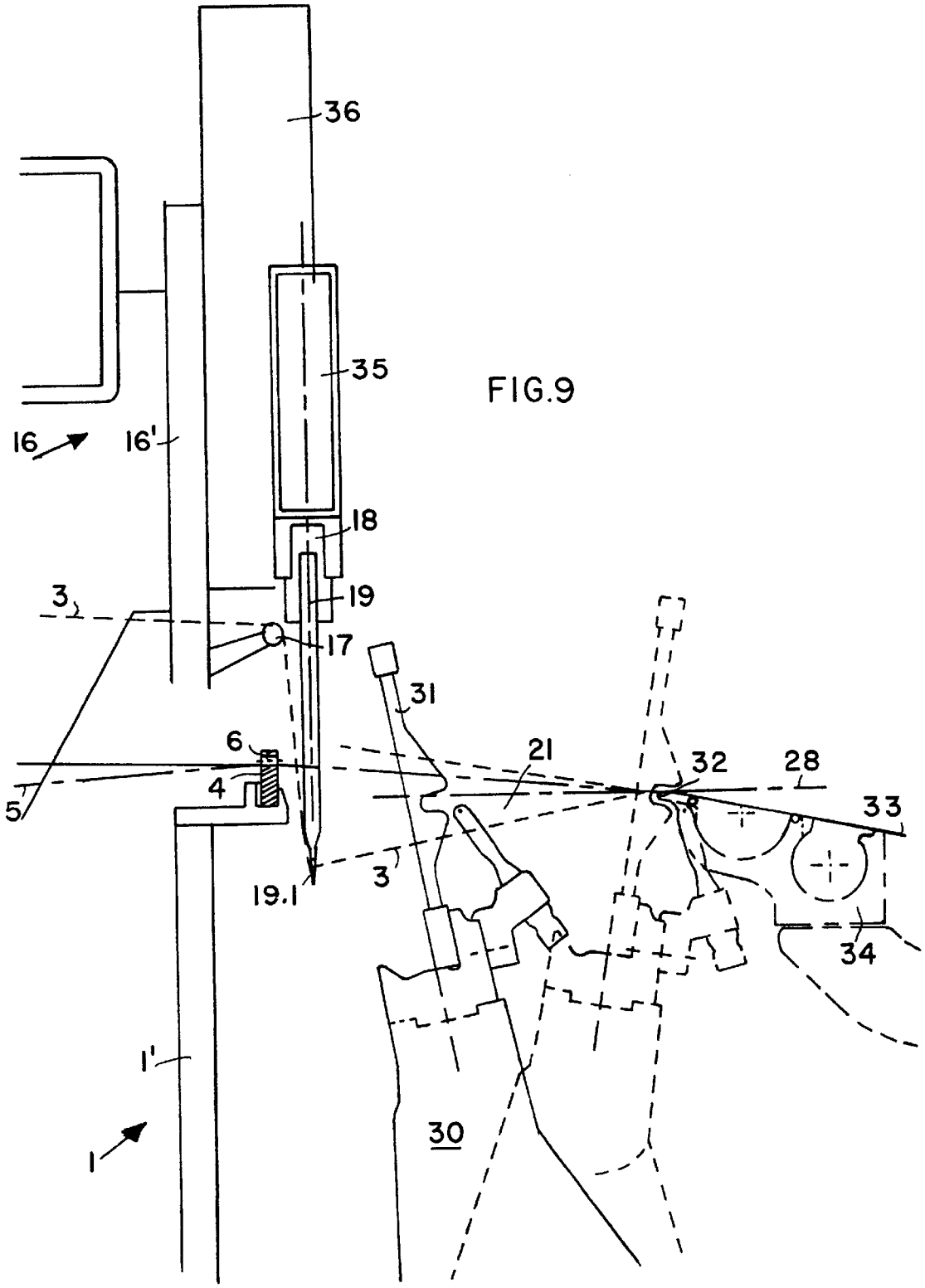
FIG. 9 shows a side view of the embodiment in which the support frames are arranged above the weaving plane while the guide means are arranged above or below the weaving plane.

During the weaving a vertical oscillating motion is imparted on the second warp control section 16 as indicated by the double arrow 20 in FIG. 3 for forming the loom shed 21 as shown in FIGS. 8 and 9. For this purpose the second section 16 is equipped at its free upper end with coupling elements 16.1 which are connected with coupling rods 22 in a pivoting or journaling manner. The coupling rods 22 in turn are journaled by journals 16.2 to bell crank levers 23 which convert the horizontal drive direction into a vertical drive direction. Further coupling rods 24 and 25 connect the bell crank levers 23 to the drive 11 as best seen in FIG. 3.

Figure 5:
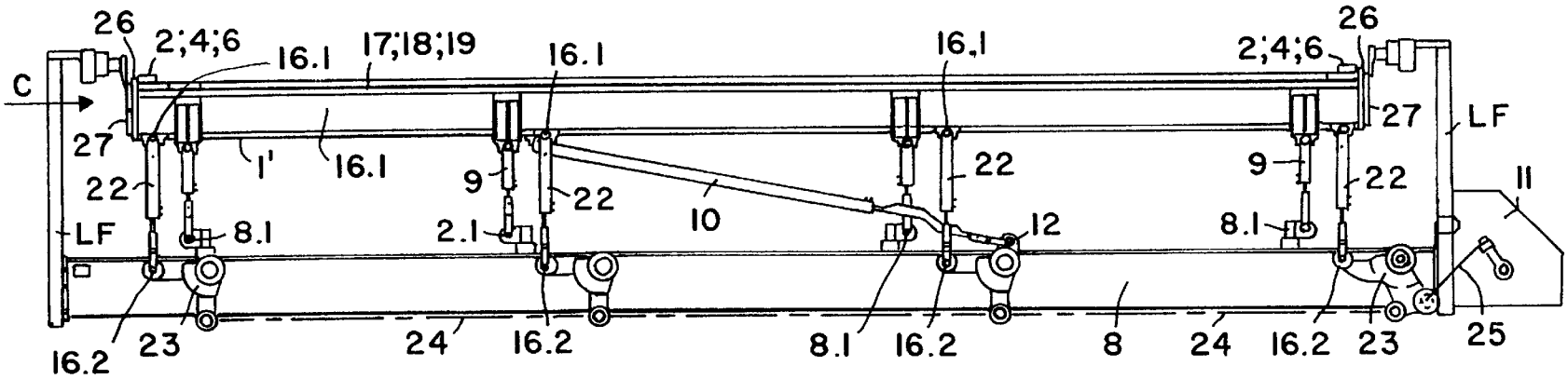
FIG. 5 is a front view of the first and second support frame construction formed as a structural unit in a weaving loom.
Figure 7:
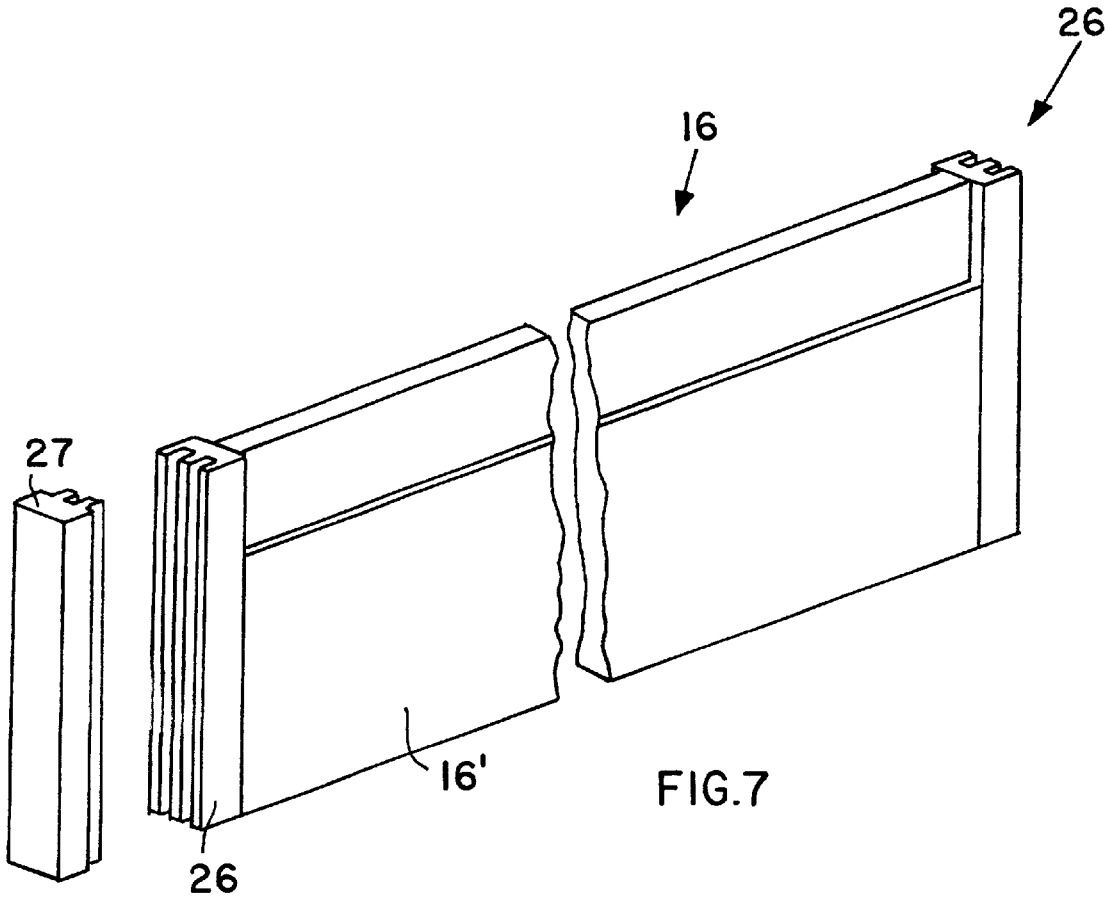
FIG. 7 is a perspective view of the second support frame structure including lateral vertical guide bars or rails.

The support frame 16' of the second section 16 is equipped with lateral guides 26 for properly guiding the frame 16' in its vertical up and down motion in a guide rails 27 shown in FIG. 7. FIG. 5 shows schematically the position of the guide elements 26 and 27 relative to the loom frame LF and relative to each other.

These guide elements 26, 27 assure a stable vertical oscillating movement of the second section 16 for the shed formation, see FIG. 7.

FIG. 4 shows that the support frame 16' of the second section 16 carries at its lower free end journal bearings 16.1 journaled to the rods 22. A needle bar 18 carrying needles 19 with needle eyes 19.1 is supported at the top of the frame 16'. The needle bar 18 is for example screwed to the upper end of the frame 16' which also carries at its upper end the detour elements 17.

FIG. 5 shows FIG. 3 superimposed on FIG. 1. The frame of the first section 1 is equipped with the guide elements 2 and with the guide rod 4. The frame 16' of the second section 16 carries the guide element 17 and the needle bar 18 with its needles 19 thereby forming a structural unit which is mounted in the loom frame LF.

Both support frames 1' and 16' are coupled according to the invention to the single drive 11 in such a way that the horizontal and vertical oscillating motions can be performed whereby these motions extend relative to each other at an angle of 90 degrees. To permit this motion the coupling elements 1.1, 8.1 and 16.1 and 16.2 connecting the coupling rods 9, 10 and 22 to the bell crank couplers 12 (FIG. 1) and 23 (FIG. 3) as well as to the coupling elements 24 and 25 to provide the required drive transmission from the single drive 11 to the first section 1 and the second section 16 in common.

Figure 6:
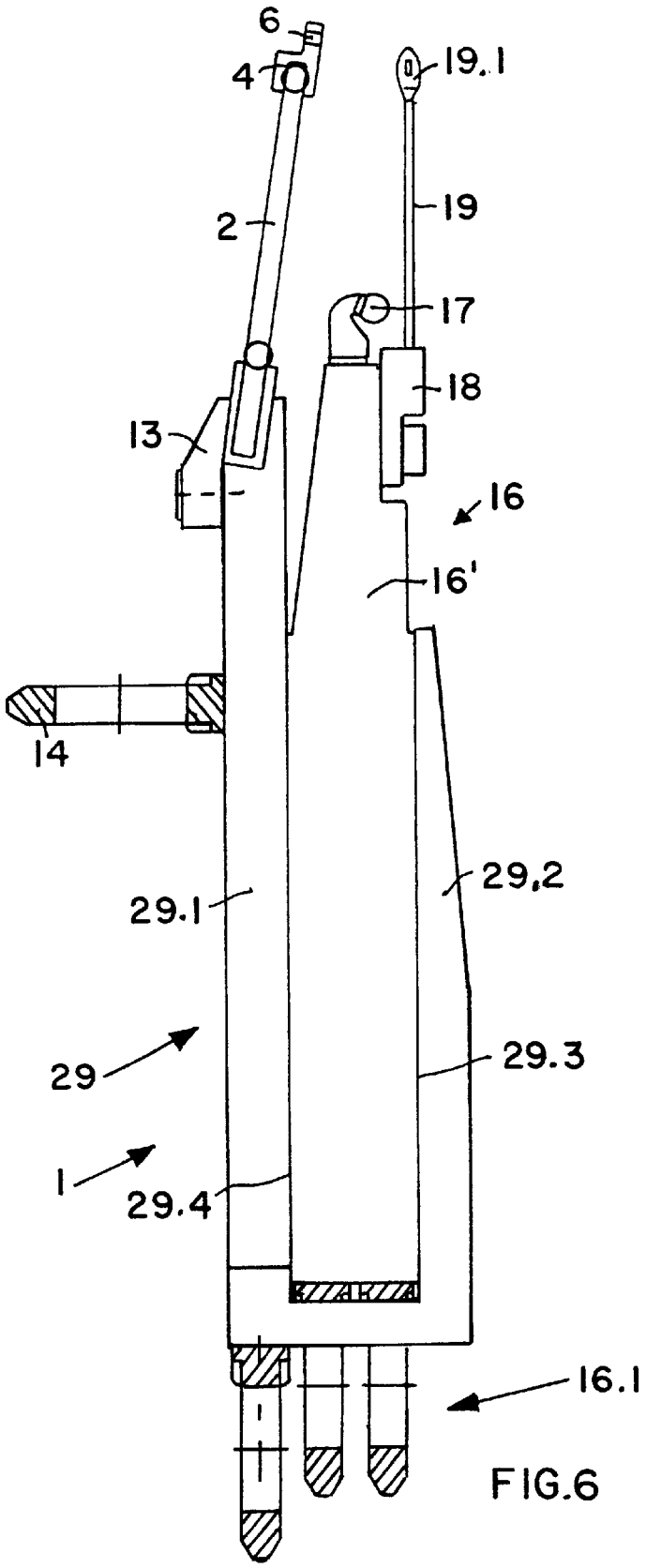
FIG. 6 shows the support frame construction having a configuration for supporting the first and second warp control section as viewed in the direction of the arrow VI in FIG. 5.

FIG. 6 shows a construction of the first warp control section 1 with the second warp control section 16 guided inside the first section 1. A modified frame structure 29 of the first section 1 guides the frame structure 16' of the second section 16. The frame structure 29 of the first section 1 has a first vertical leg 29.1 and second vertical leg 29.2 horizontally spaced from the first leg 29.1 thereby forming an upwardly open U-configuration of the frame structure 29. The first leg 29.1 carries the guide elements 2 secured to the upper end of the leg 29.1 by a clamping rod 13. The guide elements 2 carry the guide rod 4 at the upper end. The guide rod 4 is equipped with the above mentioned guide passages 6. The leg 29.1 has an inwardly facing guide surface 29.4. The leg 29.2 has an inwardly facing guide surface 29.3. These guide surfaces 29.3 and 29.4 contact the frame structure 16' of the second section 16 in a sliding and guiding manner to permit the relative vertical and horizontal motions of the second section 16 and of the first section 1, respectively. The thread detour element 17 and the needle bar 18 are secured to the top of the frame structure 16'. The needles 19 are equipped at their upper end with the needle eyes 19.1.

FIG. 7 shows the frame structure 16' of the second section 16 equipped with the guide rails 26 extending vertically along each lateral end of the frame structure 16' for cooperation with fixed guide rails 27 only one of which is shown in FIG. 7. Please also see FIG. 5.

FIG. 8 illustrates the cooperation of the first warp control section 1 and the second warp control section 16 on the one hand with the guide elements 2, 17, 19 and 19.1 on the other hand. These sections and guide elements guide the leno threads 3 and ground threads 5. More specifically the elements 2, 17, 19 and 19.1 guide the leno threads while the elements 4 and 6 guide the ground threads. In this embodiment the first section 1 and the second section 16 are arranged below the weaving plane 28 in which a weft thread is beat-up against the beat up line 32. The just mentioned elements are arranged on the side of the reed 31 facing the warp threads. The reed 31 is supported by a sley 30. FIG. 8 shows the sley 30 and the reed 31 by solid lines in the weft insertion position when the shed 21 is open. The dashed line position of the sley 30 and the reed 31 illustrates the beat up position of the reed 31 in which the weft thread is beat up against the beat up edge or line 32 of the fabric 33 by the reed 31. The position of the beat up line 32 of the fabric 33 determines the position of the weaving plane 28.

A fabric spreader or guide table 34 is positioned downstream of the beat up line 32 as viewed in the feed advance direction of the fabric 33.

A shed 21 is formed in FIG. 8 by the ground threads 5 and the leno threads 3 whereby the ground threads 5 pass through the passages 6 of the guide bar or rod 4. The leno threads are supplied by warp beams not shown but feeding the leno threads over the detour elements 17 and through the needle eyes 19.1 of the needle 19 to form the fabric 33. Similarly, further warp beams not shown supply the ground threads.

During weaving, the first warp control section 1 or rather its frame structure 1' performs together with the thread guide elements 2 and the guide rod 4 that guides the ground threads 5, a horizontal oscillating motion as indicated by the arrow 7 in FIG. 1. Simultaneously in synchronism with the horizontal oscillating motion the second warp control section 16 performs together with the detour element 17 and the needle bar 18 with the needles 19 a vertical oscillating motion as indicated by the double arrow 20 in FIG. 3. Thus, the needles 19 are oscillated vertically up and down for formation of the loom shed, whereby the needles move from a first or reversing end position below the weaving plane 28 into a second or reversing end position above the weaving plane 28.

FIG. 9 shows a further embodiment of the invention wherein the ground threads 5 are guided by the passages 6 through the guide rod 4 positioned above the weaving plane 28 at the free end of the frame structure 1' of section 1. The guide rod 4 and the frame structure 1' extend over the weaving width of the loom. The drive for performing the horizontal oscillation movement of frame structure 1' takes place in the same manner as described above with reference to FIG. 1.

In FIG. 9 the second warp control section 16 comprises a support frame 16' that is positioned at least partly above the weaving plane 28. The frame 16' carries the detour element 17 for detouring the leno threads 3. The frame 16' further carries a holding bar 35 secured by a mounting 36 to the frame 16'. The holding bar 35 carries the needle bar 18 with the needles 19. As shown, the needle eye 19.1 reaches below the weaving plane 28 from above. The detour element 17 for the leno threads 3, the mounting 36 and the frame 16' are positioned on the warp facing side of the reed 31 above the weaving plane 28. The drive of the second warp control section 16 more specifically its frame structure 16' resembles a heald shaft which is driven for the vertical up and down oscillating movement as described above with reference to FIG. 3.

Figure 10:
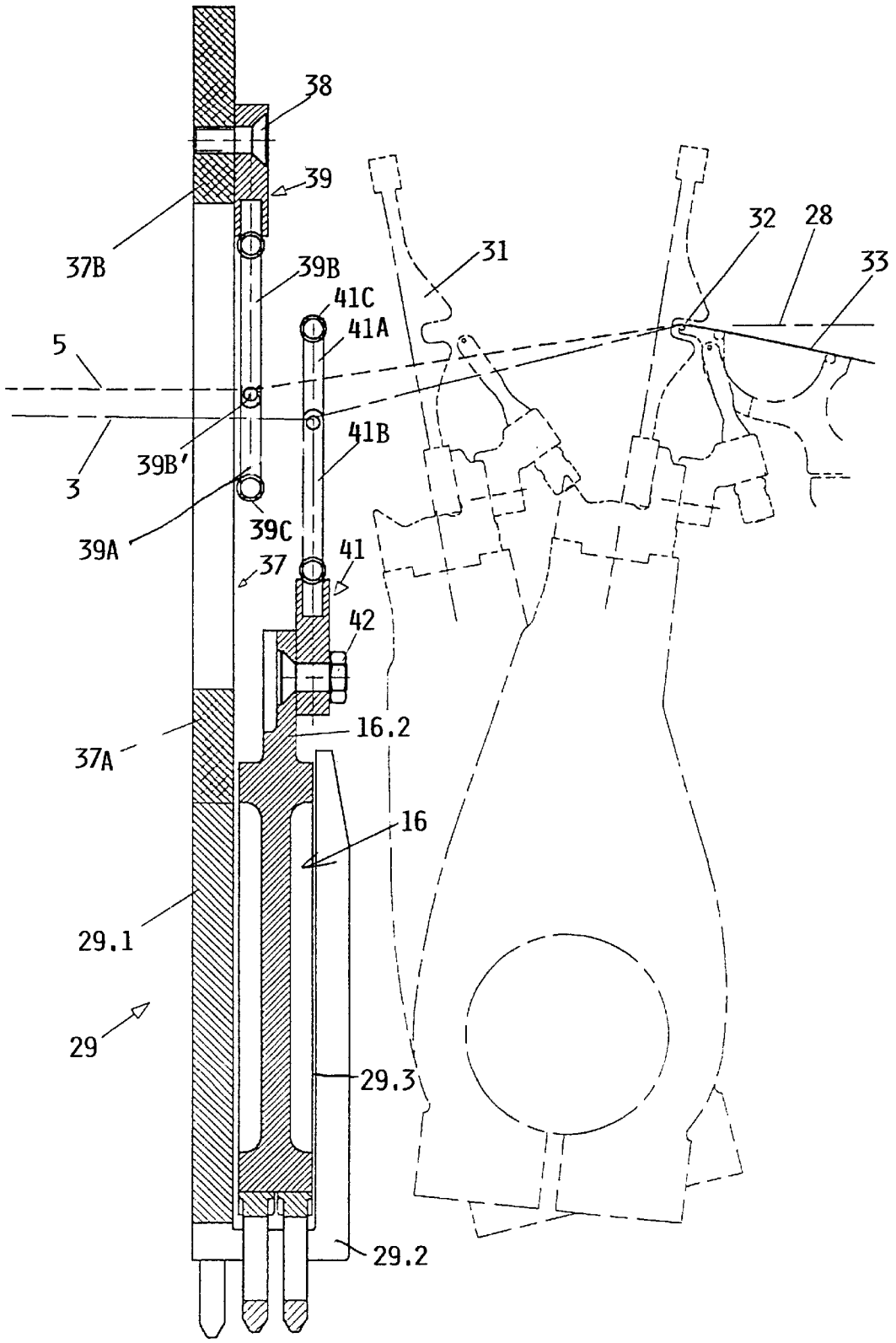
FIG. 10 shows another embodiment of the guide frames arranged below the weaving plane and carrying lamellae needle bars for the warp control.

FIG. 10 illustrates an embodiment in which the upper free end of a frame leg 29.1 of a frame 29 carries a further frame 37 resembling a heald shaft. The frame 37 has a lower crossbar 37A secured to the upper end of the frame leg 29.1 and an upper crossbar 37B to which a warp thread guide element in the form of a lamella needle bar 39 is secured by screws 38.

Figure 11:
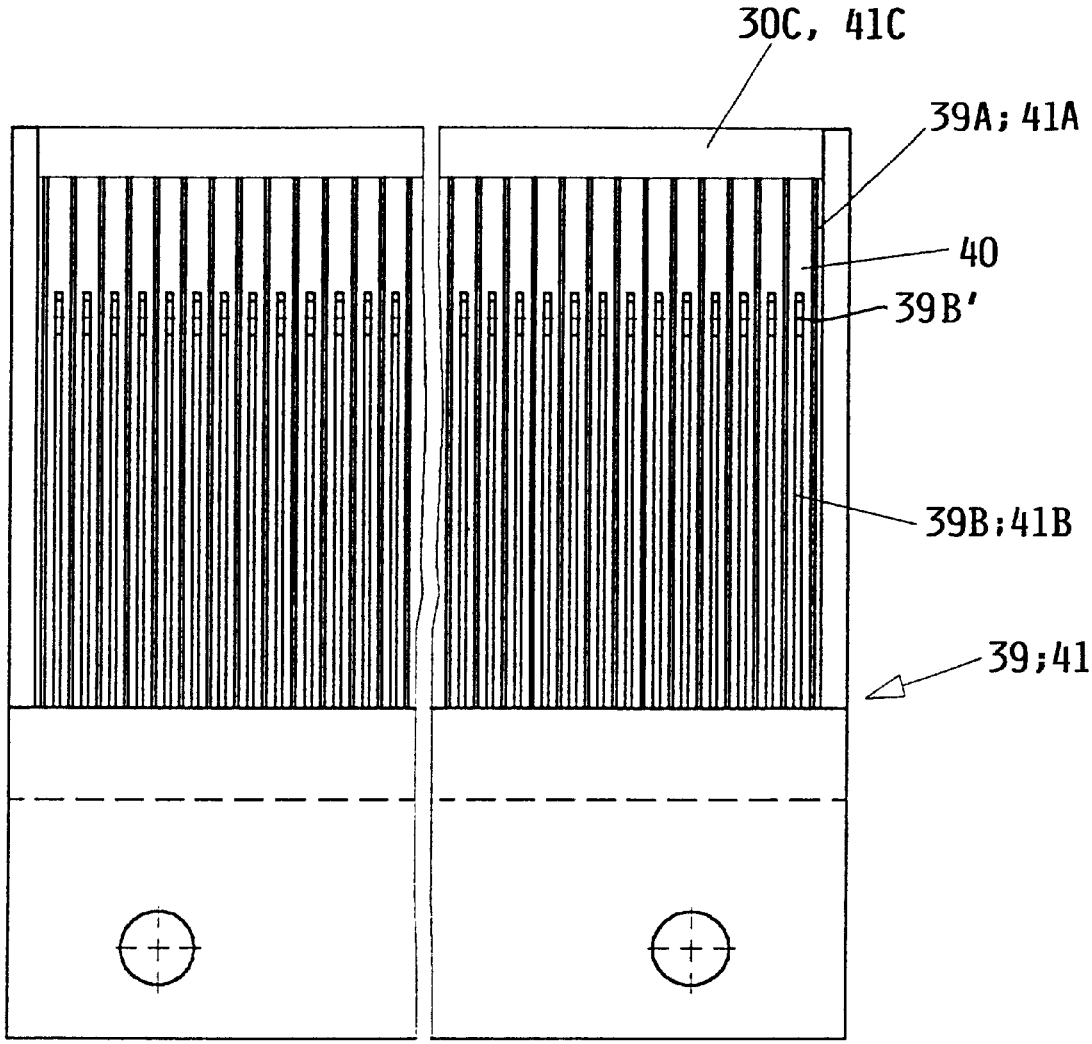
FIG. 11 shows a lamellae need bar in a front view thereof.

FIG. 11 shows a front view of a lamella needle bar 39 which is constructed identical to a second lamella needle bar 41 for the second warp control section 16. Lamellae 39A are anchored in a support structure in such a way that spacings 40 are formed between neighboring lamellae 39A and a needle 39B, 41B is mounted in the respective spacing 40. Each needle 39B, 41B has a needle eye 39B' at its upper free end. Please see also FIG. 10. Ground threads 5 pass through the needle eyes 39B' at least between a warp stop motion device not shown and the beat up line 32 of the fabric 33 or reed 31.

As mentioned the second lamella needle bar 41 is constructed identically to the first lamella needle bar 39 and has lamella 41A as well as needles 41B with respective needle eyes 41B' corresponding to the respective element 39A, 39B and 39B' of the lamella needle bar 39. A crosspiece 39C, 41C interconnects the upper free ends of the lamellae 39A, 41A whereby any gaps 40 between neighboring lamellae 39A, 41A are closed. As a result, the leno threads 3 cannot fall out of the gaps 40 when the leno threads are temporarily not under tension for example when the loom shed is changed.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weaving loom for producing a leno fabric which is woven of leno threads (3) and ground threads (5) forming warp threads and of weft threads, said weaving loom comprising a sley (30) and a reed (31) mounted on said sley, said reed defining a beat-up line (32) in a beat-up position of said reed, said beat-up line (32) extending in a weaving plane (28), said weaving loom further comprising a fabric guide (34) positioned alongside said beat-up line (32) for guiding said leno fabric downstream of said reed as viewed in a fabric withdrawal direction, and a warp control mechanism for controlling the movement of said warp threads upstream of said reed, said warp control mechanism comprising a first warp control section (1) and a second warp control section (16), said first warp control section (1) comprising at least one guide member (2) for guiding said leno threads (3) and a guide rod (4) having a first plurality of passages (6) for guiding said ground threads (5), said second warp control section (16) comprising a thread detouring element (17) for detouring said leno threads (3), and a needle bar (18) having a second plurality of needles (19) with needle eyes (19.1) for guiding said leno threads (3), wherein said first and second warp control sections (1, 16) are arranged in said weaving loom below said weaving plane (28), said weaving loom further comprising a common drive (11) operatively connected to said first and second warp control sections (1, 16) for operating said first and second warp control sections.

2. The weaving loom of claim 1, further comprising driving power transmission means (10, 12) operatively connecting said first warp control section (1) to said common drive (11) for oscillating said first warp control section (1) in a horizontal direction and for operatively connecting said second warp control section (16) to said common drive (11) for oscillating said second warp control sections (16) in a vertical direction.

3. The weaving loom of claim 1, wherein said common drive (11) is an eccentric drive.

4. The weaving loom of claim 1, wherein said common drive (11) is a loom shed forming eccentric drive.

5. The weaving loom of claim 1, wherein each of said first warp control section (1) and said second warp control section (16) comprises a first frame structure (29) and a second frame structure (16') respectively, each frame structure comprising coupling means connecting said first and second frame structures, to said common drive (11).

6. The weaving loom of claim 1, wherein said first warp control section (1) comprises an upwardly open frame structure (29) including a first frame leg (29.1) and a second frame leg (29.2) forming a U-configuration.

7. The weaving loom of claim 6, wherein said second warp control section (16) is operatively mounted between said first and second frame legs (29.1 and 29.2) of said first warp control section.

8. The weaving loom of claim 5, wherein said detouring element (17) and said needle bar (18) are arranged at an upper free end of said second frame structure (16') of said second warp control section (16).

9. The weaving loom of claim 1, further comprising a loom frame crossbeam (8), a plurality of coupling rods (9), first journals (1.1) operatively connecting a first end of said coupling rods (9) to said first warp control section (1), second journals (8.1) operatively connecting a second end of said coupling rods (9) to said loom frame crossbeam (8), and drive power transmission means (10, 12) operatively connecting said first warp control section (1) to said common drive (11) for horizontally oscillating (7) said first warp control section (1) relative to said loom frame crossbeam (8).

10. The weaving loom of claim 9, wherein each one of said coupling rods (9) comprises at least two rod sections slidable relative to each other for adjusting a rod length of said coupling rods (9).

11. The weaving loom of claim 1, further comprising a loom frame (LF), a plurality of coupling bars (22), first pivots (16.1) operatively connecting a first end of said coupling bars (22) to said second warp control section (16), a plurality of bellcranks (23) journaled to said loom frame (LF), second pivots (16.2) operatively connecting a second end of said coupling bars (22) to a respective bellcrank of said plurality of bellcranks (23), and drive power coupling means (24, 25) coupling said bellcranks (23) to said common drive (11) for vertically (20) oscillating said second warp control sections (16) relative to said loom frame (LF).

12. The weaving loom of claim 11, wherein each of said coupling bars (22) comprises at least two bar sections slidable relative to each other for adjusting a bar length of said coupling bars (22).

13. The weaving loom of claim 1, further comprising a loom frame and at least one stationary horizontal guide and coupling member (15) secured to said loom frame (LF), said first warp control section (1) comprising at least one lateral support member (14) for slidably cooperating with said horizontal guide and coupling member (15) and for laterally supporting said first warp control section (1).

14. The weaving loom of claim 13, wherein said horizontal guide and coupling member (15) comprises a spring elastic link.

15. The weaving loom of claim 13, wherein said horizontal guide and coupling member (15) comprises a rod including means for adjusting the length of the rod.

16. A weaving loom for producing a leno fabric which is woven of leno threads (3) and ground threads (5) forming warp threads and of weft threads, said weaving loom comprising a sley (30) and a reed (31) mounted on said sley, said reed defining a beat-up line (32) in a beat-up position of said reed, said beat-up line (32) extending in a weaving plane (28), said weaving loom further comprising a fabric guide (34) positioned alongside said beat-up line (32) for guiding said leno fabric downstream of said reed as viewed in a fabric withdrawal direction, and a warp control mechanism for controlling the movement of said warp threads upstream of said reed, said warp control mechanism comprising a first warp control section (1) and a second warp control section (16), said first warp control section (1) comprising at least one guide member (2) for guiding said leno threads (3) and a guide rod (4) having a first plurality of passages (6) for guiding said ground threads (5), said second warp control section (16) comprising a thread detouring element (17) for detouring said leno threads (3), and a needle bar (18) having a second plurality of needles (19) with needle eyes (19.1) for guiding said leno threads (3), wherein said first and second warp control sections (1, 16) are arranged in said weaving loom below said weaving plane (28), said weaving loom further comprising a first drive coupled to said first warp control section (1) for horizontally oscillating said first warp control section, and a second drive coupled to said second warp control section (16) for vertically oscillating said second warp control section (16).

17. The weaving loom of claim 16, wherein said first drive (11) comprises drive means selected from pneumatic drives, electromagnetic drives, and electric motor drives, and wherein said second drive comprises an eccentric cam drive.

18. A weaving loom for producing a leno fabric which is woven of leno threads (3) and ground threads (5) forming warp threads and of weft threads, said weaving loom comprising a sley (30) and a reed (31) mounted on said sley, said reed defining a beat-up line (32) in a beat-up position of said reed, said beat-up line (32) extending in a weaving plane (28), said weaving loom further comprising a fabric guide (34) positioned alongside said beat-up line (32) for guiding said leno fabric downstream of said reed as viewed in a fabric withdrawal direction, and a warp control mechanism for controlling the movement of said warp threads upstream of said reed, said warp control mechanism comprising a first warp control section (1), wherein said first warp control section (1) comprises a first frame structure (29) having a horizontal length corresponding to a weaving width of said weaving loom, said first frame structure comprising an upper guide rod (4) having a first plurality of passages (6) for guiding said ground threads (5), said upper guide rod (4) being held by said frame structure (29) in such a position that said passages (6) extend above said weaving plane (28), and wherein said second warp control section (16) comprises a second frame structure (16') positioned between said reed (31) and said first frame structure (29) of said first warp control section (1), said second frame structure having a horizontal length corresponding to said weaving width, said second frame structure comprising a thread detouring element (17) for detouring said leno threads (3) and a needle bar (18) having a second plurality of needles (19) with needle eyes (19.1) for guiding said leno threads (3), wherein said second frame structure holds said thread detouring device (17) and said needle bar (18) in a position above said weaving plane (28), said weaving loom further comprising a drive (11) operatively connected to said first frame structure (29) and to said second frame structure for operating said first and second warp control sections (1, 16).

19. The weaving loom of claim 18, wherein said drive means comprise a common drive (11) for operating said first and second warp control sections (1, 16).

20. The weaving loom of claim 18, wherein said drive means comprise a first drive operatively coupled to said first frame structure and a separate second drive operatively coupled to said second frame structure.

21. A weaving loom for producing a leno fabric which is woven of leno threads (3) and ground threads (5) forming warp threads and of weft threads, said weaving loom comprising a sley (30) and a reed (31) mounted on said sley, said reed defining a beat-up line (32) in a beat-up position of said reed, said beat-up line (32) extending in a weaving plane (28), said weaving loom further comprising a fabric guide (34) positioned alongside said beat-up line (32) for guiding said leno fabric downstream of said reed as viewed in a fabric withdrawal direction, and a warp control mechanism for controlling the movement of said warp threads upstream of said reed, said warp control mechanism comprising a first warp control section (1), wherein said first warp control section comprises a first frame structure (37), a first lamellae needle bar (39) secured to said first frame structure for guiding said leno threads (3) and said ground threads (5), wherein said second warp control section (16) comprises at least one second lamellae needle bar (41) for guiding said leno threads (3) and said ground threads (5), wherein said first and second lamellae needle bars (39, 41) are positioned upstream of said reed (31) as viewed in a feed advance direction of said fabric to face said warp threads, wherein said first lamellae needle bar (39) is arranged above said weaving plane (28) and said second lamellae needle bar (41) is arranged below said weaving plane (28) and wherein said weaving loom further comprises a common drive (11) operatively connected to said first and second warp control sections (29, 16) for driving said first and second lamellae needle bars.

22. The weaving loom of claim 21, further comprising a first crosspiece (39*c*) interconnecting free ends of all lamellae (39*a*) of said first lamellae needle bar, said first crosspiece (39*c*) extending lengthwise along said first lamellae needle bar (39), and a second crosspiece (41*c*) extending lengthwise along said second lamellae needle bar (41), said second crosspiece (41*c*) interconnecting free ends of all lamellae (41*a*) of said second lamellae needle bar (41).

23. The weaving loom of claim 22, wherein said first and second crosspieces (39*c*, 41*c*) comprise tubular sections interconnecting said free ends of said first and second lamellae (39*a*, 41*a*) respectively.

24. The weaving loom of claim 21, wherein said first lamellae needle bar (39) comprises a first support frame (29.1) including a side frame section (29.2) spaced from said first support frame (29.1) to form a guide track (29.3), and wherein said second lamellae needle bar (41) comprises a second support frame (16) slidably received in said guide track (29.3).

* * * * *

UNITED STATES PATENT AND TRADEMARK OFFICE

CERTIFICATE OF CORRECTION

PATENT NO. : 6,315,008 B1
DATED : November 13, 2001
INVENTOR(S) : Peter D. Dornier et al.

It is certified that error appears in the above-identified patent and that said Letters Patent is hereby corrected as shown below:

Column 3,
Line 62, after "a", replace "needle" by -- heddle --;

Column 5,
Line 20, before "configuration", insert -- U- --;

Column 8,
Line 32, after "of", insert -- the --.

Signed and Sealed this

Nineteenth Day of March, 2002

*Attest:*

*Attesting Officer*

JAMES E. ROGAN
*Director of the United States Patent and Trademark Office*